United States Patent [19]

Sleeper

[11] Patent Number: 4,484,745

[45] Date of Patent: Nov. 27, 1984

[54] JIGSAW PUZZLE ASSEMBLY AND STORAGE APPARATUS

[76] Inventor: John R. Sleeper, 1201 Hemlock Ct., Plano, Tex. 75023

[21] Appl. No.: 501,631

[22] Filed: Jun. 6, 1983

[51] Int. Cl.[3] ..... A63F 9/10

[52] U.S. Cl. ..... 273/157 R; 108/125; 108/161; 269/8; 273/309

[58] Field of Search ..... 273/157 R, 309; 108/125, 161; 269/8

[56] References Cited

U.S. PATENT DOCUMENTS

| | | | |
|---|---|---|---|
| 3,198,047 | 8/1965 | Munz | 269/8 X |
| 3,504,915 | 4/1970 | Walker | 273/157 R |
| 3,550,945 | 12/1970 | Resnick | 273/157 R |
| 3,792,668 | 2/1974 | Ward | 273/157 R X |
| 4,066,177 | 1/1978 | Gidley et al. | 269/8 X |
| 4,111,425 | 9/1978 | Lathrop | 273/157 R |
| 4,142,726 | 3/1979 | Anderson | 273/157 R |
| 4,302,013 | 11/1981 | Kavis | 273/157 R |

FOREIGN PATENT DOCUMENTS

| | | | |
|---|---|---|---|
| 679163 | 2/1964 | Canada | 273/239 |

*Primary Examiner*—Anton O. Oechsle

*Attorney, Agent, or Firm*—Hubbard, Thurman, Turner & Tucker

[57] ABSTRACT

A jigsaw puzzle assembly and storage apparatus is disclosed. The apparatus includes a ferromagnetic base portion preferably contructed including a thin layer of tin or steel. The base portion includes at least one beveled edge which permits a partial assembly or an entire puzzle to be shifted intact up the beveled edge and onto the base portion for storage. A flexible magnetic cover sheet is hingeably coupled to the base portion along one edge and the magnetic attraction between the entire surface of the ferromagnetic base portion and the magnetic cover sheet serves to hold a plurality of jigsaw puzzle pieces fixedly mounted in a desired relationship during horizontal or vertical storage. A preferred embodiment of the present invention includes a set of folding legs disposed on the lower surface of the base portion which permit the base portion to be utilized as a freestanding work station.

11 Claims, 2 Drawing Figures

JIGSAW PUZZLE ASSEMBLY AND STORAGE APPARATUS

BACKGROUND OF THE INVENTION

This invention relates to the field of jigsaw puzzles in general and in particular to devices useful in the assembly and storage of jigsaw puzzles.

Those skilled in the art will appreciate that jigsaw puzzles are a very popular form of entertainment. The various levels of complexity of puzzles available make the jigsaw puzzle one of the more universal pastimes in that it may be enjoyed by young and old alike. Infants are given very simple jigsaw puzzles at quite early ages and adults have for years enjoyed the challenge of extremely complex puzzles. Certain of these more complex puzzles, often numbering over one thousand small interlocking pieces, occupy an area of several square feet when assembled and may require a relatively large flat space for assembly. Typically a card table or spare family table is dedicated to the assembly of these puzzles, and since the more complex versions may require several weeks to assemble, the partially assembled puzzle represents an obstacle to other family members during its assembly.

Several recent attempts have been made to provide a dedicated work surface upon which the jigsaw puzzle may be assembled and stored during nonuse. These designs typically utilize a surface which has been treated or covered to reduce friction, or which includes provisions for pinning or gluing the puzzle pieces to the surface to prevent the partially assembled puzzle from sliding about. A transparent cover sheet is generally utilized with these devices and is usually held in place by means of latches, pressure sensitive adhesives or magnetic strips or catches along the edges thereof. Examples of these types of devices can be seen in U.S. Pat. Nos. 3,550,945; 4,302,013; 4,142,726; and, 4,111,425.

Generally these known devices have proven unsuitable for vertical storage of partially completed jigsaw puzzles due to the inability of the systems provided to prevent the partially assembled puzzle pieces from shifting during such storage.

SUMMARY OF THE INVENTION

It is therefore one object of the present invention to provide an improved jigsaw puzzle assembly and storage device.

It is another object of the present invention to provide an improved jigsaw puzzle assembly and storage device which permits a partially assembled puzzle to be securely stored in a vertical position.

It is yet another object of the present invention to provide an improved jigsaw puzzle assembly and storge device which permits individual puzzle pieces to be securely held in place without resorting to adhesives on the surface thereof.

It is another object of the present invention to provide an improved jigsaw puzzle assembly and storage device which may be utilized as a freestanding work station.

The foregoing objects are achieved as is now described. The apparatus includes a ferromagnetic base portion preferably constructed including a thin layer of tin or steel. The base portion includes at least one beveled edge which permits a partial assembly or an entire puzzle to be shifted intact up the beveled edge and onto the base portion for storage. A flexible magnetic cover sheet is hingeably coupled to the base portion along one edge and the magnetic attraction between the entire surface of the ferromagnetic base portion and the magnetic cover sheet serves to hold a plurality of jigsaw puzzle pieces fixedly mounted in a desired relationship during horizontal or vertical storage. A preferred embodiment of the present invention includes a set of folding legs disposed on the lower surface of the base portion which permit the base portion to be utilized as a freestanding work station.

BRIEF DESCRIPTION OF THE DRAWINGS

The novel features believed characteristic of the invention are set forth in the appended claims. The invention itself; however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
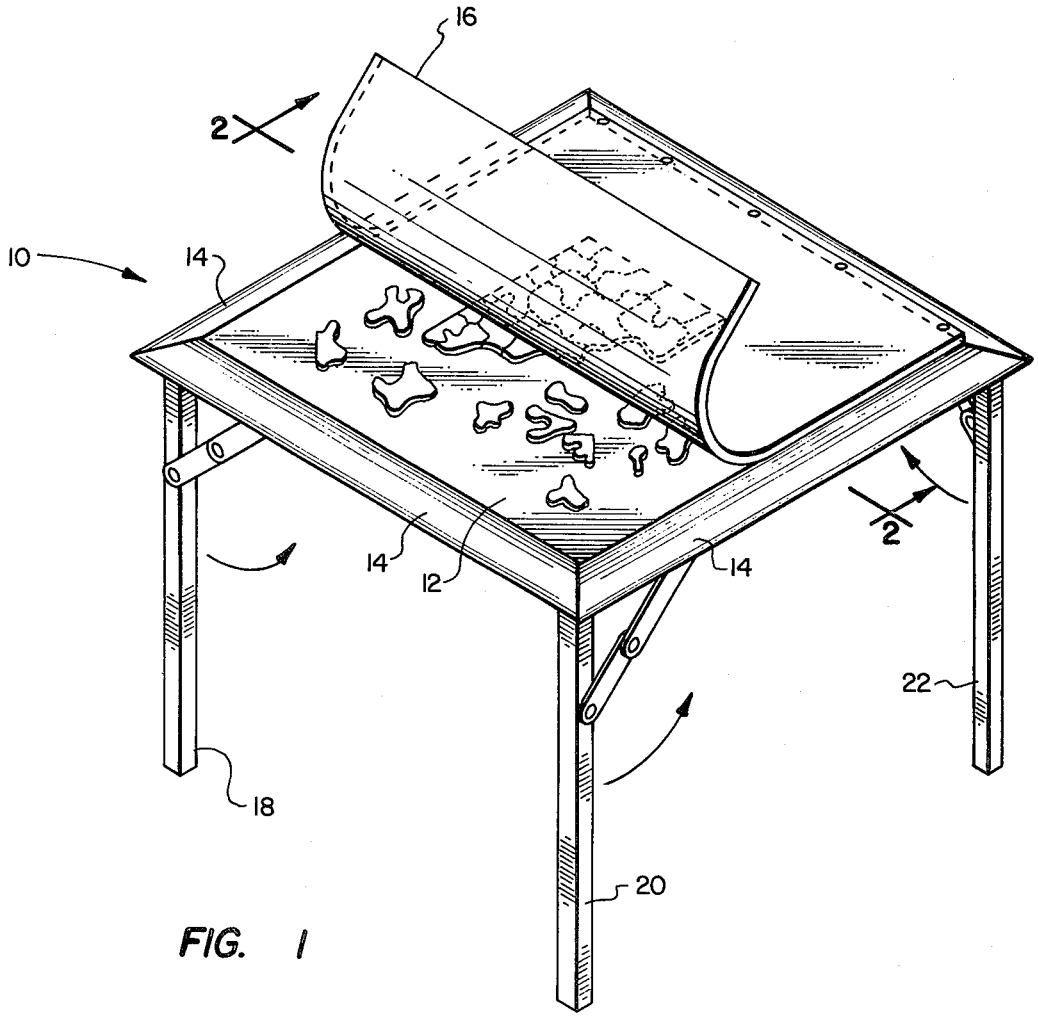
FIG. 1 is a perspective view of the novel jigsaw puzzle assembly and storage device of the present invention.

With reference now to the figures and in particular with reference to FIG. 1, there is depicted a perspective view of novel jigsaw puzzle assembly and storage device 10 of the present invention. As can be seen, assembly and storage device 10 includes a rectangular base portion 12 which is adapted to support a plurality of component jigsaw puzzle pieces and a completed puzzle. In a preferred embodiment of the present invention, base portion 12 is constructed utilizing a thin layer of a ferromagnetic material such as steel or tin which may be suitably reinforced or laminated to a foundation material such as wood or plastic.

As can be seen, base portion 12 includes a beveled edge 14 which is adapted to permit the shifting of partial assemblies or an entire puzzle from a tabletop or other flat surface onto the upper surface of base portion 12. The angle of beveled edge 14 is specifically selected such that a portion of jigsaw puzzle may be slid up the bevel of beveled edge 14 and onto the surface of base portion 12. Additionally, it can be seen that base portion 12 includes a flexible cover sheet 16 which is hingeably coupled along one edge of base portion 12 in a manner which permits it to overlie the upper surface of base portion 12. In a preferred mode of the present invention, flexible cover sheet 16 is magnetic in nature and is constructed utilizing a sheet of plastic or vinyl material which is constructed including a plurality of small magnetic particles. One example of such material is Plastiform which is manufactured by the 3 M Company of Minneapolis, Minn.

As depicted in FIG. 1, one embodiment of novel jigsaw puzzle assembly and storage device 10 of the present invention includes a plurality of folding legs 18, 20, 22 and 24 (not shown) which are mounted to the lower surface of base portion 12 and which may be extended to convert base portion 12 into a freestanding work station in much the same manner as ordinary card tables. In the folded position, legs 18, 20, 22 and 24 fold into the recessed portion of the lower surface of base portion 12 and permit base portion 12 to be placed on a tabletop or the operator's lap.

Figure 2:
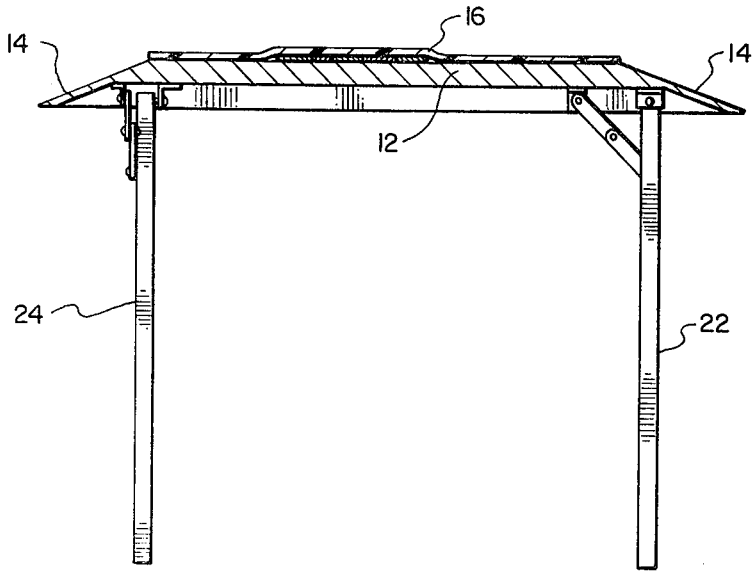
FIG. 2 is a sectional view of the novel jigsaw puzzle assembly and storage device of FIG. 1, taken along line 2—2.

Referring now to FIG. 2, there is depicted a sectional view of novel jigsaw puzzle assembly and storage device 10 of the present invention which shows the manner in which cover sheet 16 is utilized to maintain the relative positions of a plurality of component jigsaw puzzle pieces in the storage mode of the present device. As can be seen, beveled edges 14 are provided to permit individual puzzle pieces or assemblies to be slid up onto the upper surface of base portion 12 in a manner described above. Magnetic cover sheet 16 may then be selectively lowered onto the surface of base portion 12 and the magnetic attraction between magnetic cover sheet 16 and base portion 12 is then utilized to maintain the relative positions of individual jigsaw puzzle pieces on the surface of base portion 12. Unlike prior art devices which relied upon pressure sensitive adhesives or connections which were made at the edge of a cover sheet, the magnetic attraction between cover sheet 16 and base portion 12 exists throughout the entire surface of base portion 12 and thus permits a very secure mounting of individual jigsaw puzzle pieces on the surface thereof.

While there has been described what is considered to be a preferred embodiment of the present invention, it will be readily apparent that modifications may be made by those skilled in the art without departing from the scope of the teachings herein. For example, the jigsaw puzzle assembly and storage device 10 of the present invention may be fabricated to include the means for hanging base portion 12 in a vertical position while legs 18, 20, 22 and 24 are disposed in the folded position. Further, base portion 12 may be constructed utilizing only one beveled edge 14 which may be disposed on the edge of base portion 12 which is opposite the edge which is hingeably coupled to magnetic cover sheet 16. While such modifications may be made, such and other variations are intended to fit within the scope of the claims defining this invention as they are appended hereto.

What is claimed is:

1. An apparatus useful for assembling and storing at least one jigsaw puzzle comprising:

a ferromagnetic base portion for the assembly of component jigsaw puzzle pieces adapted to hold a completed jigsaw puzzle;

a flexible magnetic cover sheet overlying said base portion and hingeably coupled to said base portion along at least one edge thereof, said cover sheet adapted to impart a compressive force upon said component puzzle pieces due to the magnetic attraction exerted between said ferromagnetic base portion and said magnetic cover sheet; and a plurality of folding support members attached to the bottom of said base portion and adapted to support said base portion in a substantially horizontal position.

2. The apparatus according to claim 1 wherein said ferromagnetic base portion comprises a thin layer of steel.

3. The apparatus according to claim 1 wherein the ferromagnetic base portion comprises a thin layer of tin.

4. The apparatus according to claim 1 wherein said ferromagnetic base portion is rectangular in shape.

5. The apparatus according to claim 4 wherein said magnetic cover sheet is hingeably coupled to one side of said rectangularly shaped base portion.

6. The apparatus according to claim 4 wherein said plurality of folding support members comprise folding legs disposed at each of the four corners of said rectangular ferromagnetic base portion.

7. An apparatus useful for assembling and storing at least one jigsaw puzzle comprising:

a rectangular ferromagnetic base portion for the assembly of component jigsaw puzzle pieces adapted to hold a completed jigsaw puzzle, said base portion having at least one beveled edge thereon adapted to permit an assembly of jigsaw puzzle pieces to be easily shifted up said beveled edge onto said base portion;

a flexible magnetic cover sheet overlying said base portion and hingeably coupled to said base portion along at least one edge thereof, said cover sheet adapted to impart a compressive force upon said component puzzle pieces due to the magnetic attraction exerted between said ferromagnetic base portion and said magnetic cover sheet; and a plurality of folding support members attached to the bottom of said base portion and adapted to support said base portion in a substantially horizontal position.

8. The apparatus according to claim 7 wherein said ferromagnetic base portion comprises a thin layer of steel.

9. The apparatus according to claim 7 wherein said ferromagnetic base portion comprises a thin layer of tin.

10. The apparatus according to claim 7 wherein said magnetic cover sheet is hingeably coupled to an edge of said base portion opposite a beveled edge thereof.

11. The apparatus according to claim 7 wherein said plurality of folding support members comprise folding legs disposed at each of the four corners of said rectangular ferromagnetic base portion.

* * * * *